United States Patent [19]

Pritchard, Jr.

[11] Patent Number: 4,690,216

[45] Date of Patent: Sep. 1, 1987

[54] FORMATION FLUID SAMPLER

[75] Inventor: John J. Pritchard, Jr., Harvey, La.

[73] Assignee: Shell Offshore Inc., Houston, Tex.

[21] Appl. No.: 890,433

[22] Filed: Jul. 29, 1986

[51] Int. Cl.[4] ..... E21B 49/08

[52] U.S. Cl. ..... 166/264; 166/55; 166/165; 166/167; 166/169; 175/59

[58] Field of Search ..... 166/55, 63, 162–169, 166/264; 175/59

[56] References Cited

U.S. PATENT DOCUMENTS

| | | | |
|---|---|---|---|
| 2,951,538 | 9/1960 | Martin | 166/162 |
| 3,174,547 | 3/1965 | Fields | 166/100 |
| 3,273,659 | 9/1966 | Reynolds, Jr. | 166/169 |
| 3,384,170 | 5/1968 | Van Poollen | 166/100 |
| 3,456,504 | 7/1969 | Bombardieri | 166/264 |
| 3,653,436 | 4/1972 | Anderson et al. | 166/100 |
| 4,597,439 | 7/1986 | Meek | 166/264 |

*Primary Examiner*—Stephen J. Novosad
*Assistant Examiner*—William P. Neuder

[57] ABSTRACT

An apparatus for taking a sample of formation fluid and obtaining temperature and pressure data when the apparatus is lowered into a well casing or pipe string, said apparatus comprising: a sampling device; a gun perforator; two packers, one positioned above and the other positioned below the sampling device; and valves carried by the sampling device.

11 Claims, 2 Drawing Figures

FORMATION FLUID SAMPLER

FIELD OF THE INVENTION

This invention relates to an apparatus for taking a sample of formation fluid when lowered into a well casing or pipe string, the apparatus having both a sampling device and a gun perforator. The sampling device is equipped with multiple chambers, each chamber having at least one port in fluid communication between the inside and outside of the chamber for allowing fluid to enter thereinto from the well.

BACKGROUND OF THE INVENTION

Present samplers for sampling formation fluid allow materials associated with the drilling of a well, such as drilling muds, etc. to enter the sampler along with the formation fluid.

The object of the present invention is to provide an apparatus for sampling formation fluid so as to obtain an uncontaminated representative sample including temperature and pressure data.

SUMMARY OF THE INVENTION

The present invention is directed to an apparatus for sampling formation fluid and obtaining temperature and pressure data when the apparatus is lowered into a well casing or pipe string. Both the sampling device and gun perforator of the apparatus may be lowered into the casing or pipe string using a running string. A packer positioned below and adjacent the sampling device provides a base for resting the sampling device. A second packer positioned above the sampling device forms a closed annular space between the sampling device and the casing wall and between the first packer and the second packer.

The sampling device is provided with a plurality of chambers each having at least one port in valved fluid communication with the inside and outside of said chamber to allow fluid to enter thereinto. A valve assembly carried by each of the chambers allows the ports to selectively open for receiving formation fluid into the chambers in a sequential fashion.

An advantage of the present invention is that a representative sample of the formation fluid can be obtained after removing contaminating fluid from the sampling area of a well borehole.

Another advantage of this invention is that the number of production tests and core samples taken to obtain formation fluid samples is reduced.

A further advantage of this invention is that it can be used in most sizes of casing or bore holes and does not require specialized running equipment.

An additional advantage is that the well is killed with drilling mud when the top packer is released.

The various features of novelty which characterize the invention are pointed out with particularity in the claims forming a part of this disclosure. For a better understanding of the invention, its operating advantages and specific objects obtained by its uses, reference should be made to the accompanying drawings and descriptive matter in which there are illustrated preferred embodiments of the invention.

DESCRIPTION OF THE PREFERRED EMBODIMENT

Figure 1:
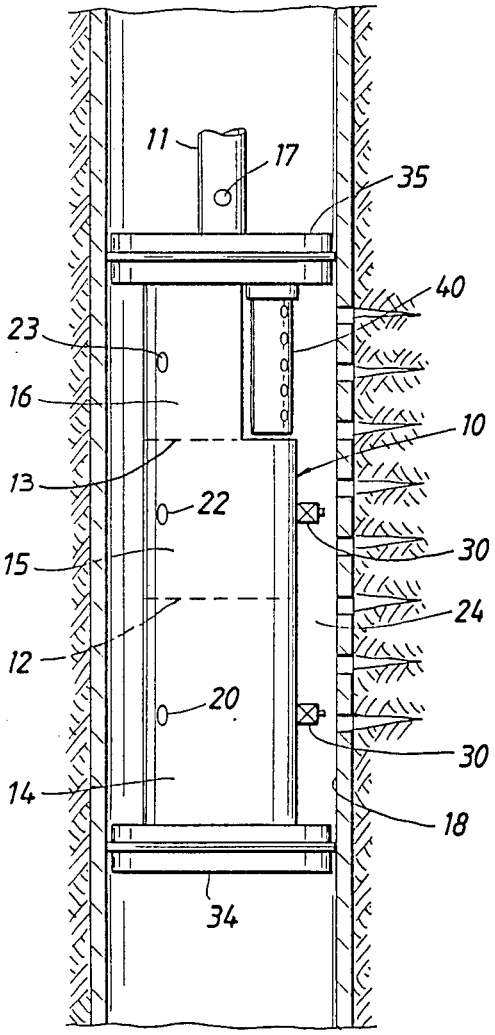
FIG. 1 is a diagrammatic view of an apparatus for sampling formation fluid.

Referring to FIG. 1 of the drawing, an apparatus for sampling formation fluid may comprise sampling means 10 lowered by pipe means, such as a running pipe string 11, said sampler 10 having wall means 12 and 13 dividing the hollow interior thereof into a plurality of chambers 14, 15, and 16. The chambers 14, 15, and 16 are axially displaced and adapted to be positioned along the longitudinal axis of a well casing or pipe string 18. Each chamber 14, 15, and 16 has at least one port 20, 22, and 23, respectively, in fluid communication between the inside and of the chambers and the space outside thereof.

A packer 34, such as a rotation set packer, operatively positioned below and adjacent the sampling device 10 and being adapted to be sealingly set forms a base for resting the sampling device 10 and anchoring means for the apparatus.

Another packer 35 operatively positioned above and adjacent the sampling device 10 and being adapted to be sealingly set forms a closed annular space 24 between the sampling device 10 and the casing 18 and between the lower packer 34 and the upper packer 35.

A pressure-actuatable perforating means 40, such as a gun perforator, is carried by the apparatus to perforate the casing wall 18. The perforator is activated in a manner well known to the art, such as by dropping a weight (not shown) to perforate the casing wall 18.

Figure 2:
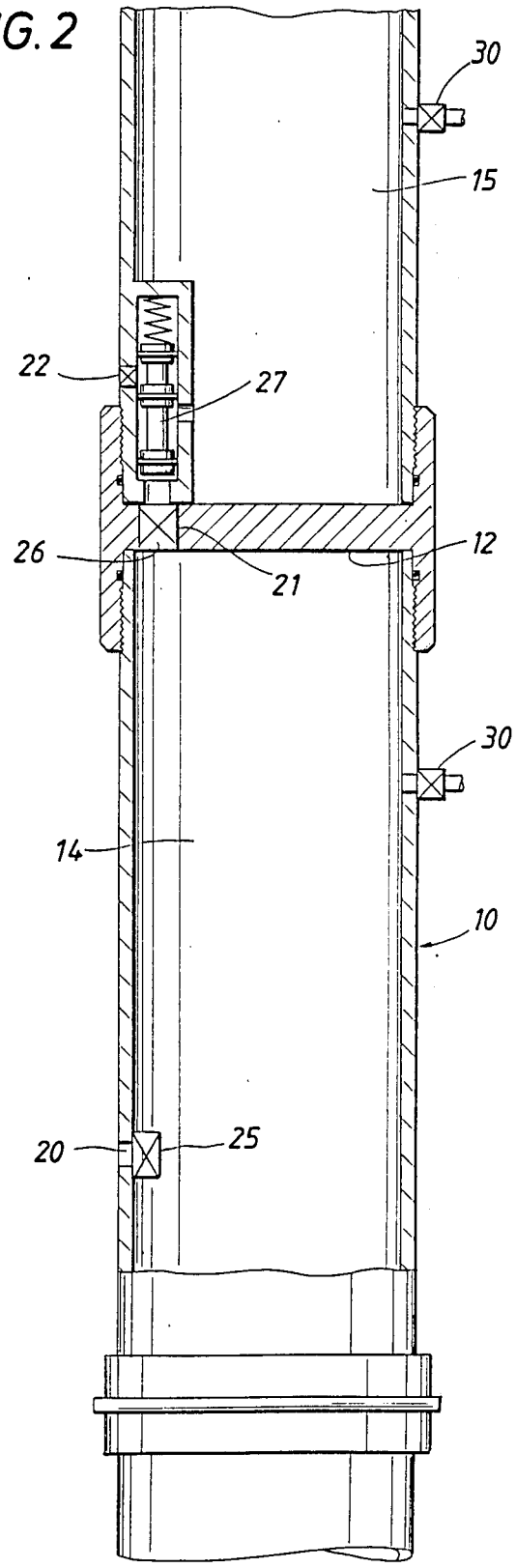
FIG. 2 is a cross-sectional schematic view of the two lowermost chambers of the apparatus.

Referring to FIG. 2 of the drawing, a port 20 is normally-closed by a pressure-actuatable valve assembly 25 carried in the wall forming the lowermost chamber 14 of the sampling device 10. Another port 21 in fluid communication between chambers 14 and 15 is normally-closed by a pressure-actuatable valve assembly 26 carried by the wall means 12 between chambers 14 and 15. A pressure-actuatable valve assembly 26 is sequentially actuatable with the valve assembly 25 caused by an increase in fluid pressure within the lowermost chamber 14.

Port 22 is normally-closed by a pressure-actuatable valve assembly 27, such as a sliding piston valve, carried by the outer wall forming chamber 15. The valve assembly 27 is operatively engageable with the valve assembly 26 to open the port 22 of chamber 15 to allow formation fluid to enter into the chamber 15.

In operation the apparatus is lowered into the well 18 on a running pipe string 11 to a selected depth where formation fluid is to be sampled. The packers 34 and 35 positioned above and below the apparatus are actuated to seal against the inner wall of the casing 18 to form a closed annular space 24 between the sampling device 10 and the casing wall 18 and between the packers 34 and 35. Fluid from a source (not shown), such as a vessel on the ocean surface, may be pumped down the running pipe string 11 and through the circulation port 17 to remove any debris on or near the firing head (not shown) of the gun perforator 40.

The gun perforator 40 is activated in a manner well known to the art, such as by pumping high pressure fluid down the running pipe string 11 to impact the firing head (not shown) of the perforator 40. Upon activating the gun perforator 40 so as to perforate the casing wall 18, the valve assembly 25 is actuated thereby allowing fluid within the closed annular space 24 and formation fluid to enter the lowermost chamber 14 first. Preferably, the volume of chamber 14, say 20–30 gallons, should be at least substantially equal to that of the volume of the annular space 24 so as to collect and confine fluids in the annular space other than formation fluid, such as drilling mud, to the lowermost chamber 14.

As the fluid pressure increases in chamber 14, the valve assembly 26 opens port 21. The valve assembly 27, being operatively engageable with the valve assembly 26, opens port 22 to allow formation fluid to enter chamber 15. As the fluid pressure increases in chamber 15, formation fluid would enter chamber 16 upon the opening of a pressure-actuatable valve 23 in the same manner as described for chamber 15.

After the formation fluid sample is obtained, the apparatus is removed from the casing 18 using the running pipe string 11 to raise the apparatus to the ocean surface or ground level in a manner well known to the art.

Additionally, temperature and pressure data within the apparatus can be obtained in a manner well known to the art, such as by any suitable gauge which is diagrammatically represented as 30 in FIG. 2.

Thus, it can be seen that the above-mentioned objective may be accomplished, based on the description of the preferred embodiment, by practicing the above-described method.

What is claimed is:

1. An apparatus for taking a sample of formation fluid when lowered into a well casing, said apparatus comprising:

sampling means having means for dividing the hollow interior thereof into a plurality of chambers axially displaced and adapted to be positioned along the longitudinal axis of said casing, each of said chambers having at least one port through an outer wall thereof for allowing formation fluid to enter thereinto;

perforating means carried by said apparatus for perforating said casing wall;

first packing means operatively positioned below and adjacent said sampling means and being adapted to be sealingly set within said casing;

second packing means operatively positioned above and adjacent said sampling means and being adapted to be sealingly set to form a closed annular space between said sampling means and said casing and between said second packing means and said first packing means;

lowering means operatively connected to said sampling means for lowering said sampling means within said casing;

first valving means carried in the outer wall forming the lowermost chamber of said sampling means for normally closing each of said ports of said chambers;

second valving means carried by the means for dividing the hollow interior of said sampling means shared by said chamber above and adjacent said lowermost chamber and said lowermost chamber, said second valving means being in fluid communication with said lowermost chamber and sequentially actuatable with said first valving means caused by an increase in fluid pressure within said lowermost chamber; and third valving means carried by the outer wall of said chamber above and adjacent said lowermost chamber, said third valving means operatively engageable with said second valving means to open the port through the outer wall of the chamber above and adjacent said lowermost chamber to allow formation fluid to enter thereinto.

2. The apparatus of claim 1 wherein said lowermost chamber includes a volume at least substantially equal to that of the enclosed annular space outside the sampling means and between said first and second packing means.

3. The apparatus of claim 1 wherein the lowermost chamber contains pressurized gas.

4. The apparatus of claim 1 wherein at least one chamber includes means for controlling the removal of pressure and formation fluid when said apparatus is raised to the surface.

5. The apparatus of claim 1 wherein at least one chamber includes means for determining pressure and temperature and obtaining a reading of the maximum pressures and temperature within the well.

6. The apparatus of claim 1 wherein at least one chamber includes means for determining pressure within the well.

7. The apparatus of claim 1 wherein at least one chamber includes means for determining temperature within the well.

8. A method for taking a sample of formation fluid when lowered into a well casing, said method comprising:

lowering an apparatus having a sampling means including a plurality of chambers in fluid communication with each other and a perforating means operatively connected thereto into a well casing;

engaging first packing means operatively positioned below and adjacent said apparatus to be sealingly set within said casing;

engaging second packing means operatively positioned above and adjacent said apparatus to be sealingly set to form a closed annulus space between said sampling means and said casings and between said second and first packing means;

actuating said perforating means carried by said apparatus to perforate said casing wall;

opening first valving means carried by the outer wall of the lowermost chamber of said sampling means to allow formation fluid to enter thereinto;

then opening second valving means carried by means for dividing said sampling means into a chamber above and adjacent said lowermost chamber and said lowermost chamber caused by an increase in fluid pressure within said lowermost chamber; and opening third valving means carried by the outer wall of said chamber above and adjacent said lowermost chamber, to allow formation fluid to enter thereinto.

9. The method of claim 8 including the step of controlling the removal of pressure and formation fluid when said apparatus is raised to the surface.

10. The method of claim 8 including the step of determining the pressure within the well.

11. The method of claim 8 including the step of determining the temperature within the well.

* * * * *